US006837811B1

(12) United States Patent
Wu

(10) Patent No.: US 6,837,811 B1
(45) Date of Patent: Jan. 4, 2005

(54) STRING PULLING DEVICE FOR RACKET STRINGER

(76) Inventor: Pao-Chang Wu, 58, Ma Yuan West St., Taichung (TW)

( * ) Notice: Subject to any disclaimer, the term of this patent is extended or adjusted under 35 U.S.C. 154(b) by 0 days.

(21) Appl. No.: 10/803,732

(22) Filed: Mar. 16, 2004

(51) Int. Cl.[7] ..... A63B 51/16
(52) U.S. Cl. ..... 473/557
(58) Field of Search ..... 473/555–557

(56) References Cited

U.S. PATENT DOCUMENTS 3,918,713 A * 11/1975 Kaminstein ..... 473/556
4,376,535 A * 3/1983 Muselet et al. ..... 473/556
4,620,705 A * 11/1986 Tsuchida ..... 473/557
2003/0027670 A1 * 2/2003 van der Pols ..... 473/557

FOREIGN PATENT DOCUMENTS

FR 2686263 * 7/1993

* cited by examiner

*Primary Examiner*—Raleigh W. Chiu

(57) ABSTRACT

A string pulling device for a racket stringer includes a base, a rotation unit, a drive unit, a string pulling unit, and a top cover. Thus, the rack of the drive unit meshes with the gear of the rotation unit, so that the rotation disk is rotated rapidly to reach the destined tension unit, thereby facilitating a user adjusting the values of the pulling stress so as to control the pond and tension required for stretching the strings of a tennis or badminton racket. In addition, the string pulling device provides a precise positioning structure.

12 Claims, 4 Drawing Sheets

STRING PULLING DEVICE FOR RACKET STRINGER

BACKGROUND OF THE INVENTION

1. Field of the Invention

The present invention relates to a string pulling device for a racket stringer, and more particularly to a string pulling device that is operated easily and exactly to adjust the values of the pulling stress so as to control the pond and tension required for stretching the strings of a tennis or badminton racket 2. Description of the Related Art A conventional racket stringer includes a string pulling device that is used to adjust the values of the pulling stress so as to control the pond and tension required for stretching the strings of a tennis or badminton racket. The conventional string pulling device for a racket stringer is disclosed in the Taiwanese Patent Publication No. 547115. However, it is difficult for the conventional string pulling device to adjust the values of the pulling stress required for stretching the strings. In addition, the conventional string pulling device includes an elastic member, such as a spring, that is normally compressed by an indication panel, so that the elastic member easily produces an elastic fatigue during a long-term utilization, thereby decreasing the lifetime of the conventional string pulling device.

SUMMARY OF THE INVENTION

The primary objective of the present invention is to provide a string pulling device that is operated easily and exactly.

Another objective of the present invention is to provide a string pulling device, wherein the rack of the drive unit meshes with the gear of the rotation unit, so that the rotation disk is rotated rapidly to reach the destined tension unit, thereby facilitating a user adjusting the values of the pulling stress so as to control the pond and tension required for stretching the strings of a tennis or badminton racket.

A further objective of the present invention is to provide a string pulling device, wherein the rotation disk is rotated to move to a determined position rapidly to prevent the position of the rotation disk from being shifted or deviated due to an external shock or an environmental stress, so that the string pulling device is operated to pull the strings exactly, thereby enhancing the precision of pulling the strings.

A further objective of the present invention is to provide a string pulling device that provides a precise positioning structure.

In accordance with the present invention, there is provided a string pulling device, comprising:

a base;

a rotation unit including a support block mounted on the base, a shaft rotatably mounted in the support block, a rotation disk secured on a first end of the shaft to rotate therewith, and a gear secured on a second end of the shaft to rotate the shaft; and a drive unit including a positioning block mounted on the base, a side plate mounted on the positioning block, a motor mounted on the side plate, a threaded rod rotatably mounted on the side plate and having a first end connected to and rotated by the motor, a movable block movably mounted on the positioning block and mounted on a second end of the threaded rod to move on the threaded rod by rotation of the threaded rod, and a rack having an end secured on the movable block to move therewith and meshing with the gear of the rotation unit to rotate the gear of the rotation unit.

Further benefits and advantages of the present invention will become apparent after a careful reading of the detailed description with appropriate reference to the accompanying drawings.

DETAILED DESCRIPTION OF THE INVENTION

Figure 1:
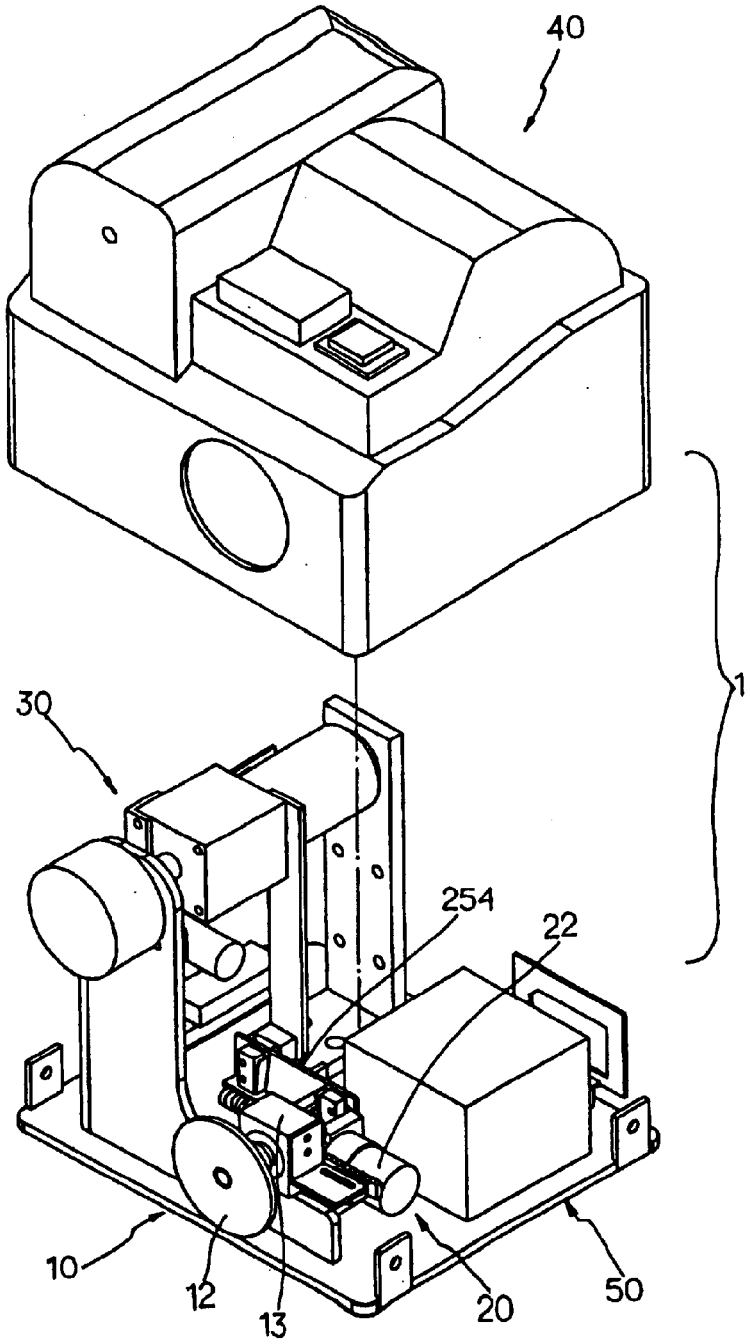
FIG. 1 is a partially exploded perspective view of a string pulling device in accordance with the preferred embodiment of the present invention.
Figure 2:
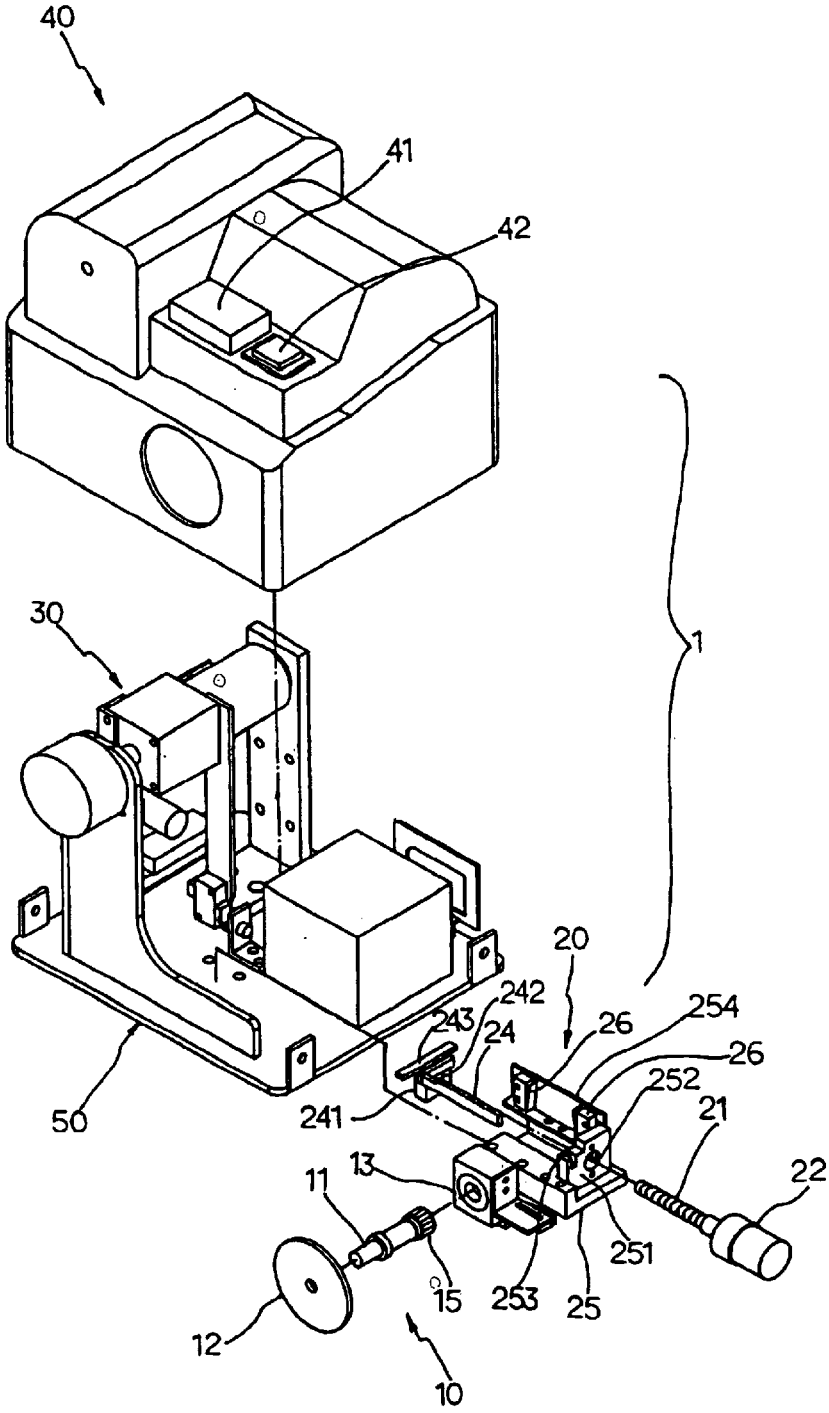
FIG. 2 is an exploded perspective view of the string pulling device in accordance with the preferred embodiment of the present invention.
Figure 3:
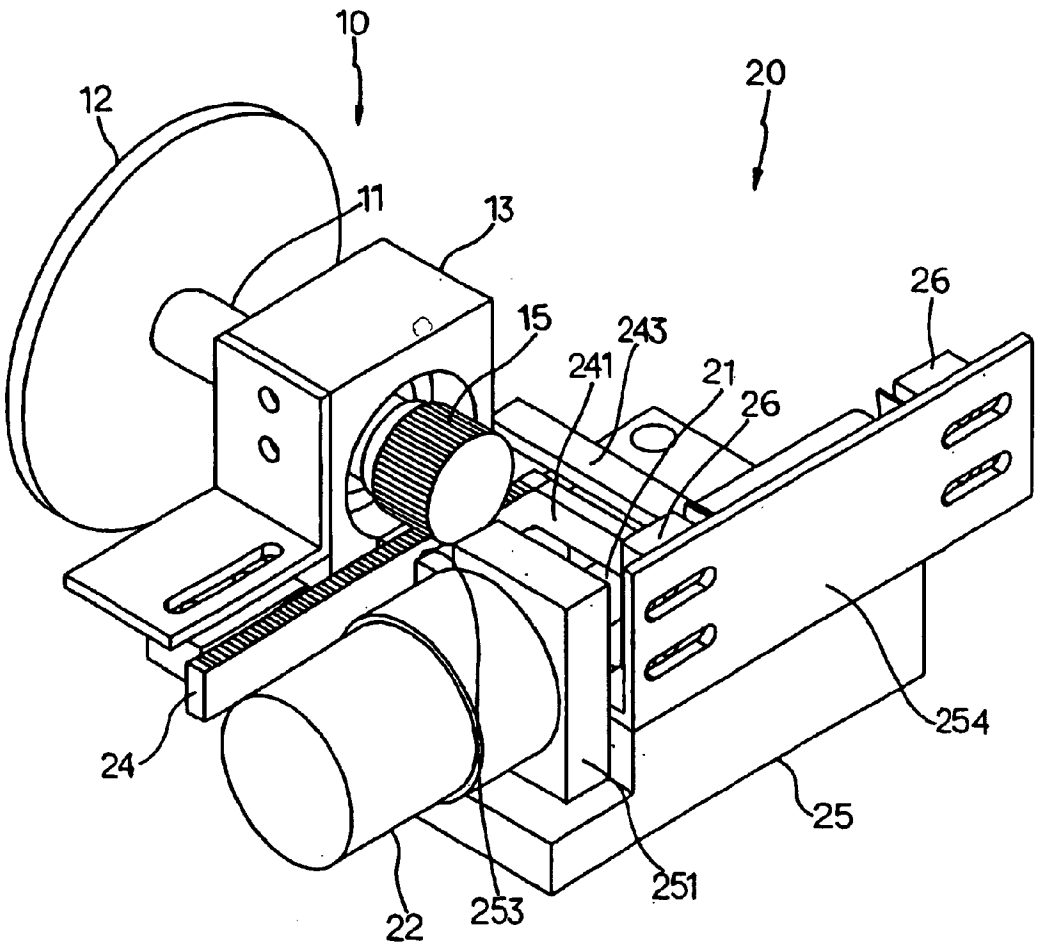
FIG. 3 is a partially enlarged perspective view of the string pulling device in accordance with the preferred embodiment of the present invention.
Figure 4:
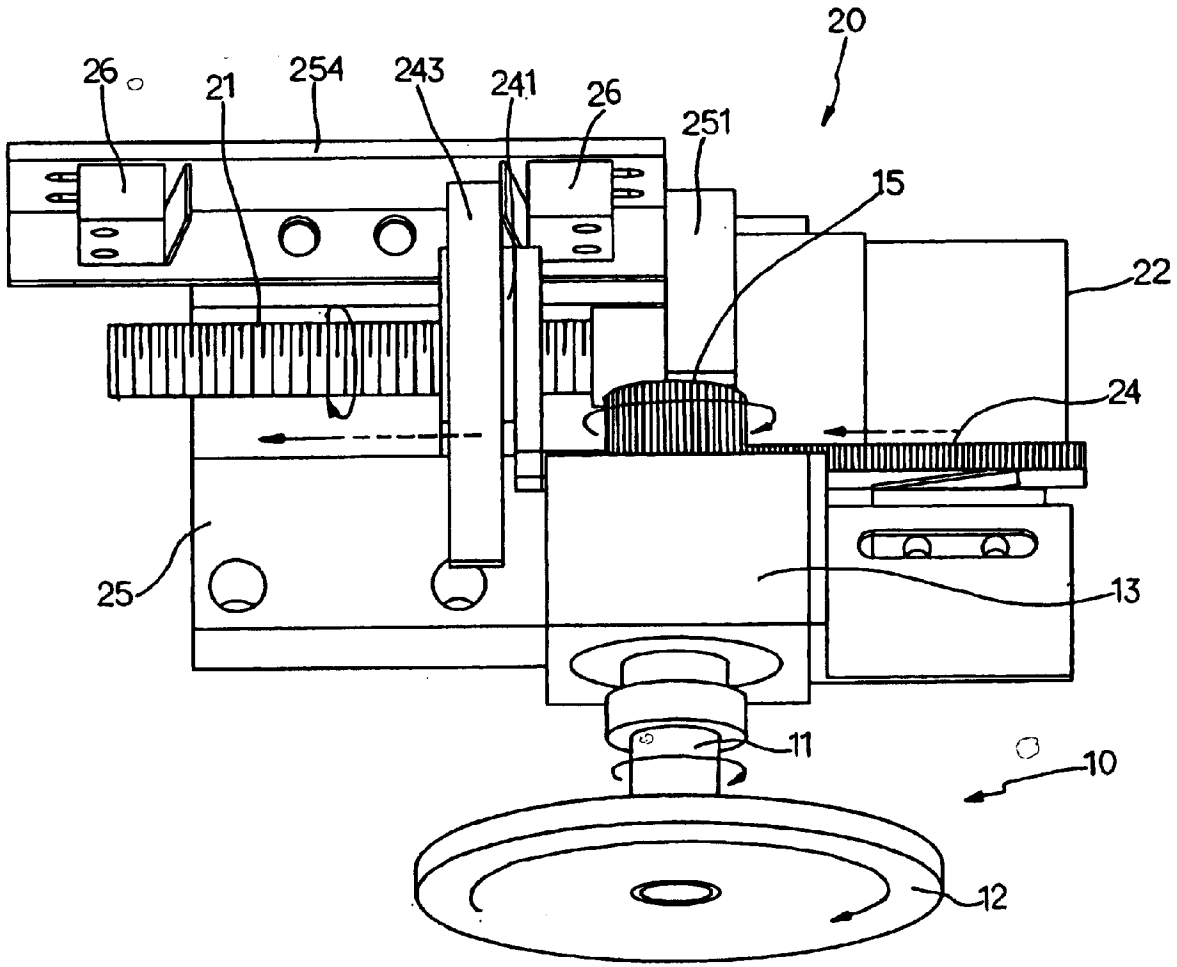
FIG. 4 is a top plan operational view of the string pulling device as shown in FIG. 3.

Referring to the drawings and initially to FIGS. 1–3, a string pulling device 1 for a racket stringer in accordance with the preferred embodiment of the present invention comprises a base 50, a rotation unit 10, a drive unit 20, a string pulling unit 30, and a top cover 40.

The rotation unit 10, the drive unit 20 and the string pulling unit 30 are mounted on the base 50, and the top cover 40 is mounted on the base 50 to cover the rotation unit 10, the drive unit 20 and the string pulling unit 30. The string pulling unit 30 is located in front of the rotation unit 10 and the drive unit 20. In practice, the rotation unit 10 co-operates with the drive unit 20 to achieve the function of adjusting the values of the pulling stress, and to use a circuit structure to control the string pulling unit 30 according the adjusted values of the pulling stress so as to control the pond and tension required for stretching the strings of a tennis or badminton racket. In addition, the top cover 40 is provided with a power switch 41 and an adjusting button 42.

The rotation unit 10 includes a support block 13 mounted on the base 50, a shaft 11 rotatably mounted in the support block 13, a rotation disk 12 secured on a first end of the shaft 11 to rotate therewith, and a gear 15 secured on a second end of the shaft 11 to rotate the shaft 11.

The drive unit 20 includes a positioning block 25 mounted on the base 50 and located beside the support block 13 of the rotation unit 10, a side plate 251 mounted on the positioning block 25, a motor 22 mounted on the side plate 251, a threaded rod 21 rotatably mounted on the side plate 251 and having a first end connected to and rotated by the motor 22, a movable block 241 movably mounted on the positioning block 25 and mounted on a second end of the threaded rod 21 to move on the threaded rod 21 by rotation of the threaded rod 21, and a rack 24 having an end secured on the movable block 241 to move therewith and meshing with the gear 15 of the rotation unit 10 to rotate the gear 15 of the rotation unit 10.

The side plate 251 of the drive unit 20 is formed with a through hole 252 for mounting the threaded rod 21. The movable block 241 of the drive unit 20 is formed with a screw bore 242 screwed onto the threaded rod 21.

Preferably, the side plate 251 of the drive unit 20 is formed with a guide channel 253 for guiding movement of the movable block 241.

The drive unit 20 further includes a support plate 254 mounted on the positioning block 25 and located in parallel with the threaded rod 21, two spaced microswitches 26 each mounted on the support plate 254, and a trigger plate 243 secured on the movable block 241 to move therewith and movable to align with one of the two microswitches 26.

The distance between the two microswitches 26 is the maximum travel distance of the movable block 241 on the threaded rod 21. Thus, when the movable block 241 is moved on the threaded rod 21, the trigger plate 243 is moved with the movable block 241 to trigger one of the two microswitches 26 so as to limit movement of the movable block 241.

In operation, referring to FIGS. 1–4, the power switch 41 on the top cover 40 is pressed to turn on the electric power. Then, the adjusting button 42 on the top cover 40 is pressed to operate the motor 22 which rotates the threaded rod 21 to move the movable block 241 which moves the rack 24 which rotates the gear 15 which rotates the shaft 11 which rotates the rotation disk 12, so that the rotation disk 12 is rotated rapidly. Preferably, the rotation disk 12 is provided with scales to confirm the adjusted values of the pulling stress. Then, the string pulling unit 30 is controlled by a circuit structure to perform the string pulling process according the adjusted values of the pulling stress.

Accordingly, the rack 24 of the drive unit 20 meshes with the gear 15 of the rotation unit 10, so that the rotation disk 12 is rotated rapidly to reach the destined tension unit, thereby facilitating a user adjusting the values of the pulling stress so as to control the pond and tension required for stretching the strings of a tennis or badminton racket. In addition, the rotation disk 12 is rotated to move to a determined position rapidly to prevent the position of the rotation disk 12 from being shifted or deviated due to an external shock or an environmental stress, so that the string pulling device 1 is operated to pull the strings exactly, thereby enhancing the precision of pulling the strings. Further, the string pulling device 1 provides a precise positioning structure.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A string pulling device, comprising:

a base;

a rotation unit including a support block mounted on the base, a shaft rotatably mounted in the support block, a rotation disk secured on a first end of the shaft to rotate therewith, and a gear secured on a second end of the shaft to rotate the shaft; and a drive unit including a positioning block mounted on the base, a side plate mounted on the positioning block, a motor mounted on the side plate, a threaded rod rotatably mounted on the side plate and having a first end connected to and rotated by the motor, a movable block movably mounted on the positioning block and mounted on a second end of the threaded rod to move on the threaded rod by rotation of the threaded rod, and a rack having an end secured on the movable block to move therewith and meshing with the gear of the rotation unit to rotate the gear of the rotation unit.

2. The string pulling device in accordance with claim 1, wherein the positioning block of the drive unit is located beside the support block of the rotation unit.

3. The string pulling device in accordance with claim 1, wherein the side plate of the drive unit is formed with a through hole for mounting the threaded rod.

4. The string pulling device in accordance with claim 1, wherein the movable block of the drive unit is formed with a screw bore screwed onto the threaded rod.

5. The string pulling device in accordance with claim 1, wherein the side plate of the drive unit is formed with a guide channel to guide movement of the movable block.

6. The string pulling device in accordance with claim 1, wherein the drive unit further includes a support plate mounted on the positioning block, two spaced microswitches each mounted on the support plate, and a trigger plate secured on the movable block to move therewith and movable to align with one of the two microswitches.

7. The string pulling device in accordance with claim 6, wherein the support plate of the drive unit is located in parallel with the threaded rod.

8. The string pulling device in accordance with claim 6, wherein the distance between the two microswitches is the maximum travel distance of the movable block on the threaded rod.

9. The string pulling device in accordance with claim 6, wherein the trigger plate is moved with the movable block to trigger one of the two microswitches so as to limit movement of the movable block.

10. The string pulling device in accordance with claim 1, further comprising a string pulling unit mounted on the base and operated by the rotation unit and the drive unit.

11. The string pulling device in accordance with claim 10, further comprising a top cover mounted on the base to cover the rotation unit, the drive unit and the string pulling unit.

12. The string pulling device in accordance with claim 11, wherein the top cover is provided with a power switch and an adjusting button.

* * * * *